United States Patent [19]

Allen

[11] 4,027,421

[45] June 7, 1977

[54] WHEELED VEHICLE CONSTRUCTION KIT

[75] Inventor: Robert K. Allen, Hinsdale, Ill.

[73] Assignee: Marvin Glass & Associates, Chicago, Ill.

[22] Filed: Jan. 28, 1976

[21] Appl. No.: 653,262

[52] U.S. Cl. ..... 46/17; 46/201; 46/251

[51] Int. Cl.[2] ..... A63H 17/00

[58] Field of Search ..... 46/16, 17, 201, 202

[56] References Cited

UNITED STATES PATENTS

| | | | |
|---|---|---|---|
| 1,309,240 | 7/1919 | Chappuis | 46/16 |
| 2,587,142 | 2/1952 | Gray et al. | 46/17 |
| 2,757,482 | 8/1956 | Brown et al. | 46/201 |
| 3,074,202 | 1/1963 | Sloane | 46/201 |
| 3,634,969 | 1/1972 | Hartling | 46/202 |
| 3,914,898 | 10/1975 | Ferguson | 46/202 |

FOREIGN PATENTS OR APPLICATIONS

| | | | |
|---|---|---|---|
| 26,861 | 10/1954 | Finland | 46/201 |

*Primary Examiner*—John F. Pitrelli
*Assistant Examiner*—Robert F. Cutting
*Attorney, Agent, or Firm*—Mason, Kolehmainen, Rathburn & Wyss

[57] ABSTRACT

A child's entertainment or hobby kit in the form of a constructable wheeled vehicle having a plurality of components which are connected by interconnecting frame members in a manner which permits them to be disassembled and rearranged. The vehicle includes a longitudinally elongated frame member on which a pair of rear wheels are removably mounted by a unitary rear wheel support member slidably and frictionally fit on one end of the frame member. A front wheel is removably mounted by a fork to the front end of the elongated frame member by a pair of T-connectors between the frame member and a front wheel mounting member. The T-connectors each include three recesses which slidably receive and frictionally engage the frame member, an intermediate connecting shaft, and the front wheel mounting member. Other connectors are provided for removably mounting a simulated engine, a figure riding toy, a spark plug shaped back rest, and rear stabilizing fin. Alternatively, a self-contained removably mounted power driven unitary rear wheel support member is provided to propel the vehicle across a suitable supporting surface.

15 Claims, 6 Drawing Figures

Fig 1
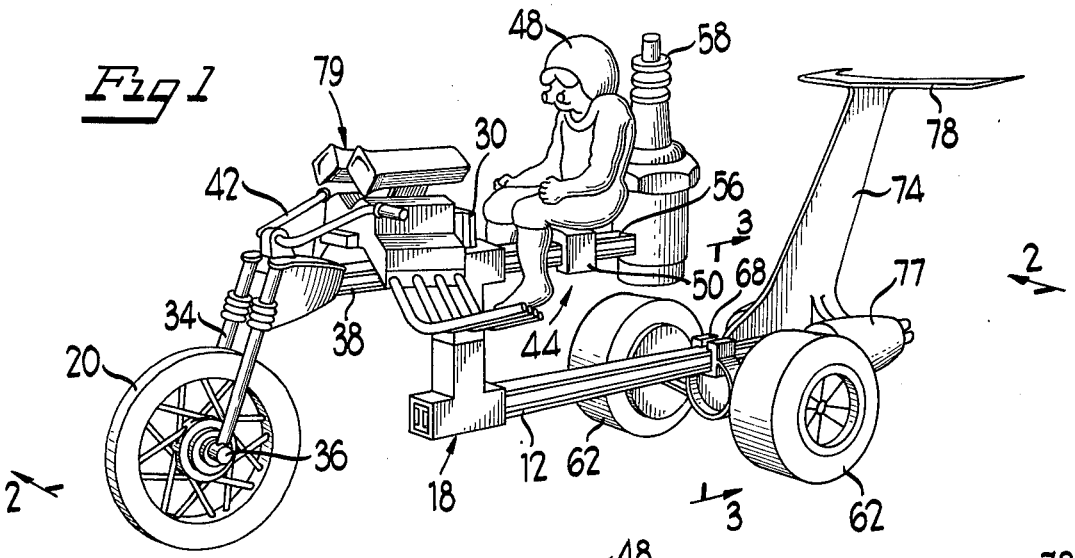
Fig 2
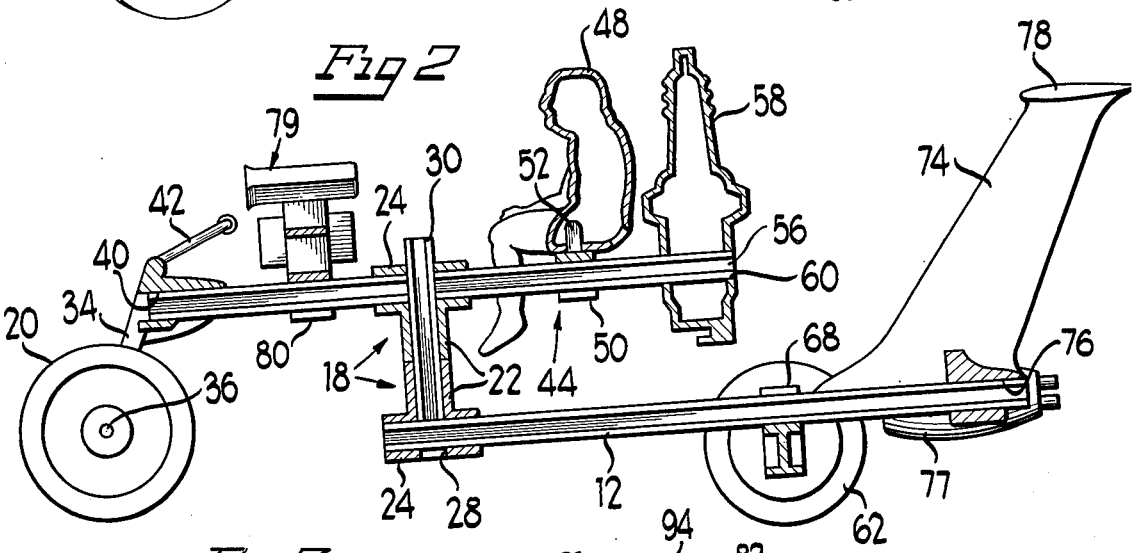
Fig 3
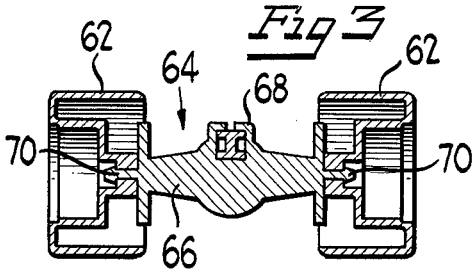
Fig 4
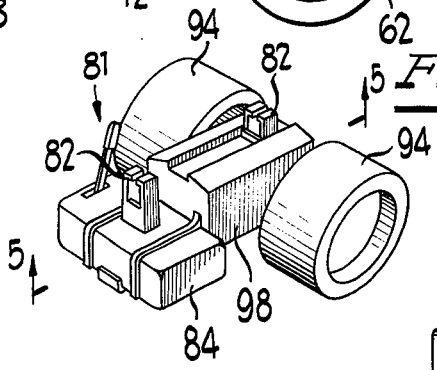
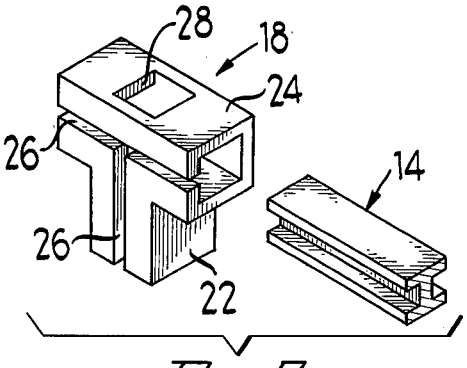
Fig 6
Fig 5
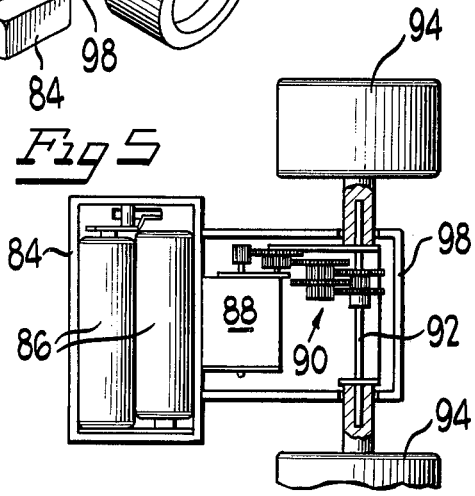

WHEELED VEHICLE CONSTRUCTION KIT

BACKGROUND OF THE INVENTION

1. Field of the Invention

The present invention relates to construction type toy devices and in particular to a constructable toy wheeled vehicle having removably mountable interconnected parts.

2. Description of the Prior Art

Component type toy vehicles disclosed in the prior art are mostly of the type which provide a plurality of different components which may be substituted for various other components to provide different functions. The individual parts of these vehicles are separable from the main body or frame of the vehicle, but must be reassembled in the same manner to return the vehicle to an operating state. However, none of the prior art devices provide a vehicle which can be redesigned by rearranging the individual components on the main frame.

SUMMARY OF THE INVENTION

A vehicle with rotating wheels capable of rollably moving upon a gravity supporting surface. The vehicle includes a number of separate component parts which are removably mounted and arranged upon connecting beams. The components are provided with gripping fittings to permit the rearrangement of the various components with respect to each other, varying the distances between the components, interchanging components, or removal thereof. The beams are inserted into the fittings attached to the various components or coupling fittings so provided. Apertures in the fittings are slightly smaller than the beams inserted therein. Aperture slots in the walls of the fittings permit the insertion thereinto of the connecting beams thereby providing a gripping detachable connection.

More particularly, the present invention provides a wheeled toy vehicle including a longitudinal frame member having a pair of wheels removably mounted to the frame member by a unitary rear wheel support. At least one front wheel is removably mounted by a front wheel mounting member and a connecting means to the frame. The connecting means comprises a pair of T-connectors slidably connecting the frame member to the front wheel mounting member to secure the wheels in alignment for rollingly supporting the vehicle over a suitable surface. The vehicle includes a plurality of accessories including a simulated motor and means for removably connecting the motor to the vehicle, means for removably mounting a figure toy to the vehicle, a removable back rest, and a removable rear stabilizing fin. Alternatively, a power driven unitary rear wheel support member is provided for self propelling the vehicle over a supporting surface.

BRIEF DESCRIPTION OF THE DRAWINGS

FIG. 1 is a perspective view of the toy wheeled vehicle of the present invention;

FIG. 2 is a vertical central section, taken generally along the line 2—2 of FIG. 1;

FIG. 3 is another vertical section, taken generally along the line 3—3 of FIG. 1;

FIG. 4 is a perspective view of the accessory power driven rear wheel support;

FIG. 5 is a horizontal section of the rear wheel support, taken generally along the line 5—5 of FIG. 4; and FIG. 6 is a perspective view, on an enlarged scale, of one of the T-connectors and a section of the frame member.

DESCRIPTION OF THE PREFERRED EMBODIMENT

Referring to the drawings in greater detail, the toy vehicle of the present invention, generally designated 10, is illustrated in the form generally representing a three-wheel motorcycle. The vehicle 10 includes a main, longitudinally extending, elongated frame member 12. The frame member 12 and various other members to be described in detail hereinafter are generally in the shape of an I-beam, generally designated 14 in FIG. 6. The frame member 12 is made of plastic or other suitable material so that it is substantially rigid but capable of flexing slightly. A pair of T-connectors (one of which is shown in FIG. 6), generally designated 18, are provided for securing a front wheel 20 to the frame. Each T-connector includes a generally square cross sectional hollow vertical base portion 22 and a generally square cross sectional hollow horizontal cross or top portion 24 connected to the base portion 22 at right angles. Lengthwise slots 26 are provided in the T-connectors 18 so that each portion may flex slightly in order to slidably receive and frictionally engage one of the I-beam type members 14. Additionally, a square aperture 28 is provided at the top end of the T-connector 18 for slidably receiving an I-beam member 14 therein.

Referring to FIGS. 1 and 2, two T-connectors 18 are mounted with their base portions 22 adjacent one another by a vertical I-beam shaft 30 at the forwardmost end of the frame member 12, with the frame member 12 inserted into the lower T-connector 18. The front wheel 20 is mounted by a front wheel mounting means including a fork 34 for rotatably mounting the front wheel, about an axis 36, onto the front of an upper forwardly directed beam member 38 which is received in a complementary recess 40 at the top of the fork 34. A pair of handle bars 42 are mounted on the top of the fork, as on a conventional motorcycle. The beam member 38 is slidably and frictionally fit within the top of the uppermost T-connector 18.

Connecting means, generally designated 44, are provided for mounting a figure toy 48 on the vehicle as shown in FIGS. 1 and 2. The connecting means 44 includes a generally square cross sectional hollow portion 50 which includes an upstanding pin 52 (FIG. 2) for attachment through a complementary aperture in the figure toy. The connecting means 44 slidably engages a rearwardly directed upper beam member 56 which mounts in the rearward top portion of the upper T-connector 18.

A back rest 58 is provided in the form and shape of an exaggerated spark plug which is slidably and frictionally engaged to the rearward end of the beam 56 by a suitable aperture 60 therein.

A free wheeling pair of rear wheels 62 are rotatably mounted by a unitary rear wheel support member, generally designated 64 as shown in FIG. 3. The support member 64 includes a transverse axle portion 66 including a square cross sectional connector 68 on the top thereof which slidably mounts on the rearward end of the frame member 12. The wheels 62 are rotatably mounted on the axle 66 by a pair of pins 70 which mount the wheels 62 by a snap fit. A rear stabilizing fin 74 is mounted on the rearwardmost end of the frame member 12 by a generally square aperture 76 therein which frictionally maintains the fin 74 on the frame member. The stabilizing fin 74 includes a generally horizontal spoiler 78 at the uppermost end. A pair of simulated jet engines 77 are provided on either side of the stabilizing fin 74 to give the vehicle 10 the appearance of a jet powered motorcycle. Additionally, or in conjunction with the jet engines 77, a simulated motor, generally designated 79, may be mounted on the forwardly directed beam 38 by a similar connector 80.

As can be seen from the above description and the drawings, since all of the mounting elements, and mounting frame members, are complementary, the various elements may be rearranged to provide a differently designed vehicle. For example, the figure toy 48 may be switched with the motor 79 so that the toy figure will be adjacent the handle bar set 42. Likewise, the stabilizing fin 74 may be switched with the back rest 58 to again change the appearance of the vehicle.

As will be discussed below, the free wheeling rear support wheels 62 may be replaced by a power driven pair of wheels to self-propel the vehicle over a suitable supporting surface.

More particularly, an optional power drive unit. generally designated 81 (FIG. 4), is provided to self-propel the vehicle 10 over a suitable supporting surface. The optional power drive 81 replaces the free wheeling rear wheel unit 64 and includes a pair of generally square cross sectional connectors 82 which mount the drive unit 81 to the frame member 12. The power drive unit includes a power supply casing 84 for mounting a pair of batteries 86. The batteries 86 are connected to an on-off means which connects the batteries, when in the "on" position, to a drive motor 88. Power from the drive motor 88 is transmitted through a gear train 90 to a rear wheel drive shaft 92 for rotating a pair of rear wheels 94 mounted thereon to drive the vehicle. The rear wheels 94 are rotatably mounted within a power drive housing 98 which through the connectors 82, mounting the drive means 81, to the main frame 12, drives the vehicle across a suitable supporting surface.

The foregoing detailed description has been given for clearness of understanding only and no necessary limitations should be understood therefrom as some modifications will be obvious to those skilled in the art.

I claim:

1. A construction kit in the form of a wheeled toy vehicle, comprising:

a front-to-rear elongated frame;

front wheel means removably mountable generally at the front of said frame;

rear wheel means removably mountable generally at the rear of said frame; and a plurality of different vehicle components removably mountable at various selected positions along the frame in front of said front wheel means, between the front and rear wheel means, and behind said rear wheel means so as to permit changing the characteristic appearance of the vehicle by choice selection of the particular positions of the vehicle components.

2. The construction kit of claim 1 wherein said frame includes at least one front-to-rear elongated I-beam member, and said front wheel means, said rear wheel means, and said vehicle components have apertures complementary in shape with said I-beam member for slidably positioning thereof at selected positions along the I-beam member.

3. The construction kit of claim 1 wherein said front wheel means includes a fork for rotatably mounting a front wheel, the upper end of said fork being removably mountable on the front end of said frame.

4. The construction kit of claim 1 wherein one of said vehicle components comprises a simulated vehicle motor removably mounted at any selected position along the frame.

5. The construction kit of claim 1 wherein said removably mountable rear wheel means includes a support member having drive means connected to the rear wheel means for propelling the vehicle across a supporting surface.

6. The construction kit of claim 5 wherein said drive means includes a motor, a power supply for energizing said motor, selectively operable on-off means, and a drive train connected to said rear wheel means to transmit power from the motor to the rear wheel means.

7. The construction kit of claim 1 including a simulated figure and mounting means for removably mounting said figure to said frame and a back rest in the form of a simulated spark plug, constructed in exaggerated proportions relative to said figure, removably mounted on said frame rearwardly of said figure.

8. A construction kit in the form of a wheeled toy vehicle, comprising:

a front-to-rear elongated frame;

front wheel means removably mountable generally at the front of said frame;

rear wheel means removably mountable generally at the rear of said frame; and a plurality of different vehicle components removably mountable at various selected positions along the frame so as to permit changing the characteristic appearance of the vehicle by choice selection of the particular positions of the vehicle components, wherein said frame includes an upper beam-like member on which said front wheel means is removably mounted generally at the front end thereof and a lower beam-like member on which said rear wheel means is removably mounted generally at the rear end thereof, said upper and lower beam-like members being secured in a vertically spaced relationship.

9. The construction kit of claim 8 wherein said upper beam-like member extends forwardly beyond the front end of said lower beam-like member, and said lower beam-like member extends rearwardly beyond the rear end of said upper beam-like member.

10. The construction kit of claim 9 wherein the rear end of said upper beam-like member and the forward end of said lower beam-like member are secured together by a readily removable connecting means.

11. The construction kit of claim 10 wherein said upper and lower beam-like members are secured together by a pair of T-connectors slidably mounted on the members with vertical apertures therethrough for receiving therein a vertical connector beam.

12. The construction kit of claim 11 wherein said T-connectors have T-shaped apertures therethrough for receiving the upper and lower beam-like members and said vertical beam.

13. A construction kit for constructing various configurations of a wheeled toy vehicle, comprising:

an upper front-to-rear elongated frame member, a lower front-to-rear elongated frame member, a vertical elongated connector means connecting the upper and lower frame members so that the upper frame member protrudes forwardly beyond the front end of the lower frame member and the lower frame member protrudes rearwardly beyond the rear end of the upper frame member, front wheel means removably mountable generally at the front end of said upper frame member, rear wheel means removably mountable generally at the rear end of said lower frame member, and a plurality of vehicle components removably mountable on either of said upper or lower frame members.

14. The construction kit of claim 13 wherein at least two of said removably mountable vehicle components comprises a figure toy and a simulated vehicle motor selectively positionable on said frame members.

15. The construction kit of claim 13 wherein said upper and lower frame members are in the form of beam-like structures and said front wheel means, said rear wheel means, and said vehicle components have apertures therethrough complementary in shape with the cross-sectional dimensions of said frame members so as to be slidably receivable thereon at any desired position.

* * * * *